United States Patent [19]

Strudel

[11] 4,337,634

[45] Jul. 6, 1982

[54] EXTERNALLY HELD CYLINDRICAL EXPANDER FOR TUBULAR WARES

[75] Inventor: Werner Strudel, Friedrichshafen, Fed. Rep. of Germany

[73] Assignee: Lindauer Dornier Gesellschaft mbH., Fed. Rep. of Germany

[21] Appl. No.: 199,636

[22] Filed: Oct. 22, 1980

[30] Foreign Application Priority Data

Dec. 12, 1979 [DE] Fed. Rep. of Germany ..... 2949876

[51] Int. Cl.[3] ..... B21B 17/00; B21B 25/02; B29D 7/24

[52] U.S. Cl. ..... 72/113; 72/133; 72/127; 72/370; 264/565; 425/393; 425/403

[58] Field of Search ..... 72/113, 118, 119, 206, 72/254, 256, 264, 370, 393, 127, 133; 113/120 M; 425/393, 403; 264/565

[56] References Cited

U.S. PATENT DOCUMENTS

| | | | |
|---|---|---|---|
| 1,016,587 | 2/1912 | Swartzlander | 72/113 |
| 3,160,918 | 12/1964 | Berggren et al. | 425/403 |
| 3,296,343 | 1/1967 | Buttolph et al. | 264/565 |
| 3,397,564 | 8/1968 | Schroeder | 72/113 |

FOREIGN PATENT DOCUMENTS

| | | | |
|---|---|---|---|
| 10594 | of 1906 | United Kingdom | 72/254 |
| 318480 | 6/1972 | U.S.S.R. | 264/565 |

*Primary Examiner*—Lowell A. Larson
*Attorney, Agent, or Firm*—James E. Bryan

[57] ABSTRACT

This invention relates to an improvement in an externally held cylindrical expander for tubular ware with a central support for radially adjustable, spreading rest means and sector-shaped longitudinal elements borne by said rest means, in particular for the treatment of the tubular ware with liquid treatment means, the longitudinal elements extending between bodies tapering in the longitudinal direction, mounted between the ends of the support, and acting as entry and exit means, the improvement comprising: (a) rollers with axes of rotation transverse to the ware transport direction T mounted on the outsides of the individual longitudinal elements in transverse planes of the expander, (b) the rollers located in a common transverse plane covering the gaps between rollers located in an adjoining transverse plane, (c) the rollers from adjoining transverse planes mounted on one longitudinal element overlap by their ends at the center of the longitudinal element, (d) the other ends of the rollers project beyond the side edges of the longitudinal element and overlap with the rollers of the adjoining longitudinal element, and (e) the rollers evince a convex profile of such kind that the convex curvature of all rollers located in a common transverse plane on the expander periphery coincides with the smallest settable circumference of the expander in its unspread position.

4 Claims, 5 Drawing Figures

EXTERNALLY HELD CYLINDRICAL EXPANDER FOR TUBULAR WARES

Figure 1:
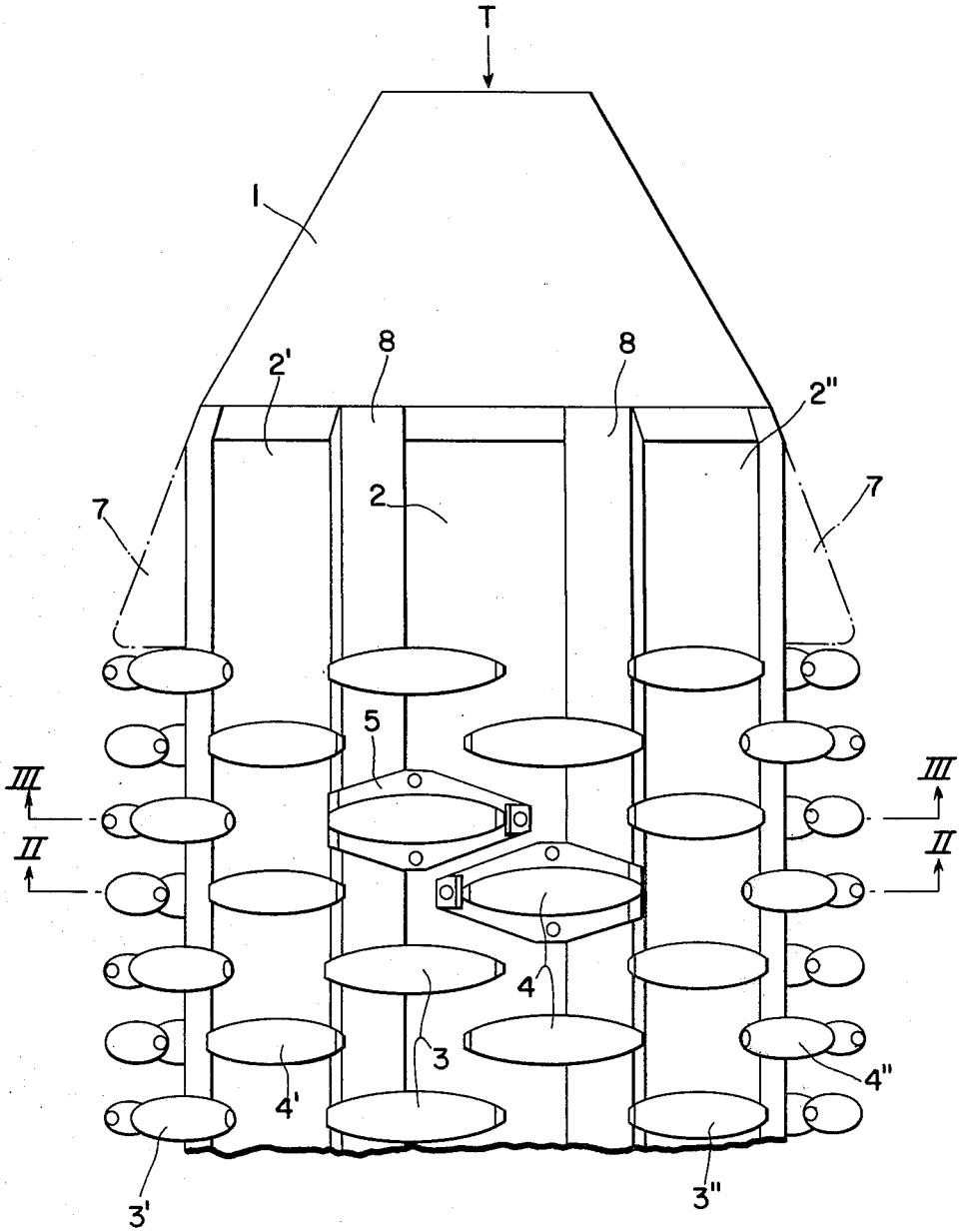

This invention relates to an externally held cylindrical expander for tubular ware with a central support for radially adjustable, spreadable rest means and sector-shaped longitudinal elements borne by the rest means.

Expanders are known in a variety of designs. One of their essential features is that they contain guide elements extending in the direction of motion of the ware and which can expand outwardly, resting from the inside against the tubular ware and thus expanding and tensioning it. Matching rollers are placed externally into recesses of the expander, whereby it is kept suspended.

As a rule, the expanders are flat in their design and consist of two parallel mutually spreadable longitudinal shoes over which the tubular ware is drawn. However, other expanders also are known, which tension not only in a plane and keep the ware flat, but instead spread in three dimensions.

Furthermore, an externally held expander for tubular wares already has been proposed, which comprises radially adjustable, spreadable rest means at a central support, these rest means bearing sector-shaped guide elements for the treatment of the tubular ware, especially with liquid treatment means. As regards this expander, a longitudinally tapered body is mounted to each of the ends of the central support as entry and exit components, and the guide elements extend in the longitudinal direction of the expander between those tapered bodies. Support and transport rollers rest externally against the bodies, these rollers being adapted in their profiles to the shapes of the tapered bodies. In lieu of the support and transport rollers resting against the tapered bodies, it also has been proposed to keep the expander in its suspended position by means of flow action. The higher pressures and the strip-shaped marks due to the previously conventional matching rollers are eliminated when using the special design of the support and transport rollers or by supporting the expander with a flow means. Such an advantage is especially marked when the ware following liquid treatment is still moist or wet. Even though the guide elements may be convex and may be parts of a cylindrical surface, nevertheless gaps will be created between the individual guide elements when the expander is spread, so that the periphery, and hence the tensioned tubular ware, will consist of a polygon of convex and intermediary plane sectors, the ware resting only on the convex guide or longitudinal elements, while being freely tensioned along the latter plane sectors.

As regards the proposed cylindrical expander, wavy clearances in the manner of fluting furthermore may be provided at least in that part of the guide or longitudinal elements which are exposed to the liquid treatment, namely in their surface and transversely to the transport direction of the ware. The wavy clearances in the surfaces of the longitudinal elements permit improved action by the treatment medium from both sides on the tubular ware. For that purpose, spray nozzles for the treatment medium are annularly mounted outside the expander and around it.

The invention begins with a cylindrical expander of the latter kind. It was found in practice that the treated ware will not remain wholly free of lengthwise marks because the longitudinal elements extending in the direction of ware transport may leave perceptible traces on the ware. It is the object of the invention to prevent even those minor lengthwise marks from forming.

Figure 2A:
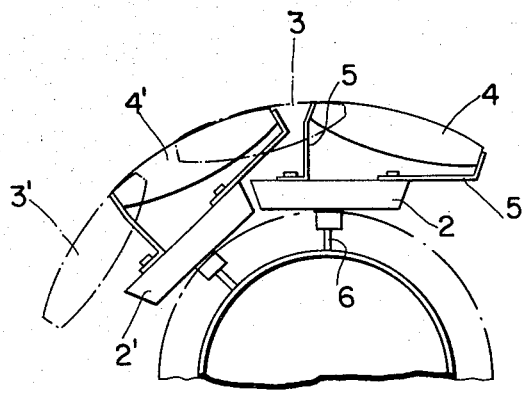
Figure 2B:
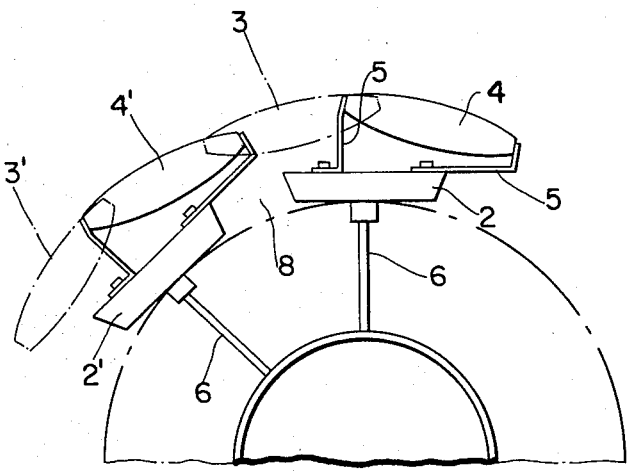
Figure 3A:
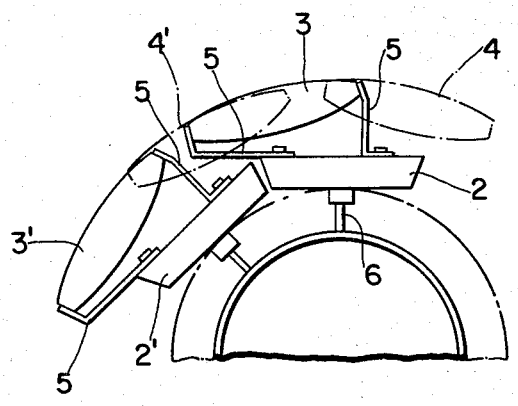
Figure 3B:
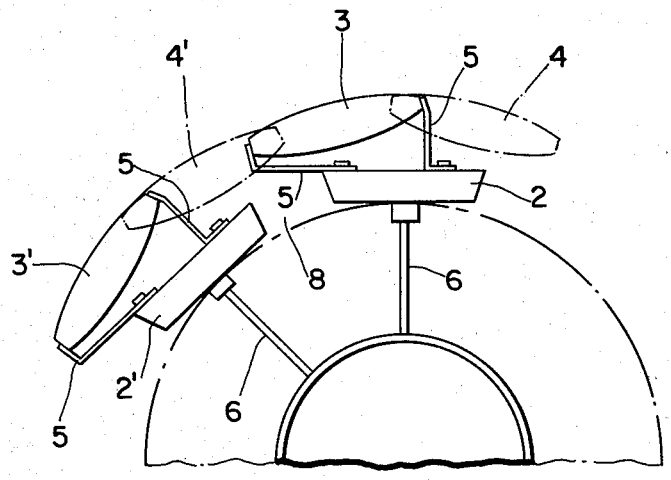

One illustrative embodiment is explained below in relation to the drawings, in which:

FIG. 1 is a side view of the upper part of a cylindrical expander,

FIGS. 2*a* and 2*b* are cross-sections of FIG. 1 taken along line II—II, and FIGS. 3*a* and 3*b* are cross-sections of FIG. 1 taken along line III—III.

FIG. 1 is a simplified representation of a cylindrical expander with a frustrum-of-cone entry body 1. The arrow T indicates the ware transport direction. Obviously the design of the expander is not restricted to any particular transport direction, rather the ware also can be drawn in the opposite direction over the expander. Several parallel longitudinal elements 2,2′ or 2″ extending in the ware transport direction are shown after the entry body 1. The longitudinal elements extending between the entry and exit bodies correspond to the guide elements cited in the foregoing introduction, although they no longer exert any direct guidance function. Gaps 8 are located between these longitudinal elements. For the sake of simplicity, the rest means for the longitudinal elements and their adjusting means are omitted. The individual longitudinal elements 2, 2′ or 2″ are all of the same design, and therefore the description of design and operation can be restricted to that of the single longitudinal element 2. Each longitudinal element 2 contains two sets of rollers, each set being arranged in the longitudinal direction of the longitudinal elements. The roller axes of rotation are shown dashed and run transversely to the transport direction T. The one set contains the rollers 3, and the other set the rollers 4. The two sets of rollers are mutually laterally offset and furthermore mutually longitudinally offset. Advantageously the rollers 4 of one of the sets are opposite the gaps between the rollers 3 of the other set. A holding means 5, for one of the rollers of each set, is indicated in FIG. 1. For the sake of simplicity, these holding means are omitted for the remaining rollers. As shown by FIGS. 2*a*, 2*b*, and 3, these may be simple screw-on fasteners 5. The surface of the longitudinal element 2 no longer need be convex and a part of a cylindrical surface, rather, it can be planar. Preferably all rollers are identical in design and their profile is convex. The profile will be discussed further below. The arrangement of the rollers on the individual longitudinal elements is such that those rollers 3, 3′, 3″ and 4, 4′, 4″ which correspond as regards their height are located in a common transverse plane of the expander on the individual longitudinal elements 2, 2′, 2″. Illustratively, FIGS. 2*a* and 2*b* show a transverse plane for rollers 4 as II, and a transverse plane for rollers 3 as III. The rollers 3 and 4 located in two adjoining transverse planes are so mutually offset in a lateral manner on their associated longitudinal elements 2 that at the center of the longitudinal element 2, they still overlap somewhat by their ends. The other ends of the rollers 3 and 4 project beyond the sideways edges of the longitudinal element 2 and penetrate the gap 8 relating to the adjoining longitudinal element 2′ and 2″ respectively. The ends of these rollers also project sufficiently that for the maximum spreading of the expander when in operation, an overlap between one roller 3 and one roller 4′ from adjoining transverse planes and adjoining longitudinal elements takes place.

Accordingly, the guidance of the tubular ware is displaced from the surface of the above cited guide elements to the sets of rollers of the longitudinal elements. Furthermore, the inclines 7 may be provided at the beginning and end of each longitudinal element 2 so as to facilitate the transition from the entry or exit body 1 to the sets of rollers.

The rollers from two adjoining planes overlap as a whole sufficiently that they cover the entire periphery of the tubular ware which is to be treated.

FIGS. 2 and 3 explain a further significant feature of the invention. These Figures show cross-sections of the expander in FIG. 1 along the transverse planes II and III shown in FIG. 1. FIGS. *2a* and *3a* each show the cross-section for the least expander periphery, while FIGS. *2b* and *3b* show the cross-section for the maximum spreading of the expander. The longitudinal elements 2 and 2' are shown in FIGS. *2a* through *3b*. They are represented here as flat-discs. The rest means for the longitudinal elements 2, i.e., the adjusting arms for spreading, are indicated at 6.

In FIGS. *2a* and *2b*, the rollers 4 and 4' are located in a common transverse plane II and are shown in solid lines, on their fasteners 5. The rollers 3 and 3' are shown in dash-dot lines and belong to the adjoining transverse plane III. The axes of rotation of all the rollers are transverse to the transport direction T. The convexity of the rollers is clearly shown in the drawing; it is such that a pair of rollers from neighboring transverse planes, for instance rollers 3 and 4 of the guide element 2, so complement one another that the convex curvature of the one roller continues in the convex curvature of the other. The cross-sectional outside boundary of the two convex shapes lies on a circle concentric with the expander. The origin of this circle in FIG. *2a* is on the axis of the expander. The convex curvature furthermore meets the requirement that the circle is continued in the pair of rollers 3', 4' of the adjoining longitudinal element 2'. This circle formed by the convex curvatures of rollers 4, 3, 4', 3', and viewed in projection corresponds to the least expander periphery that can be set in operation. The longitudinal elements 2 and 2' of the expander then are close to one another and the gap between them is shrunk to a narrow slot.

FIG. *2b* shows the expander in the spread-open position. The adjusting arms 6 therefore are shown longer. Further, the gap 8 between the adjoining longitudinal elements 2 and 2' now is larger. The relative position of the rollers 3 and 4 mounted on one longitudinal element remains unchanged. Again it is clearly seen that the convex curvature of the two rollers 3 and 4 complements itself into an arc of circle. At the center of the longitudinal element 2, the two ends of the two rollers 3 and 4 overlap. The same applies to the pair of rollers 3', 4' on the longitudinal element 2'. Because of the spreading, i.e., opening of the expander, and the generation of the gap 8, the spacing between the roller 3 of longitudinal element 2 and the roller 4' of the longitudinal element 2' is changed with respect to FIG. 2, however. Here also it can be clearly seen that the ends of the rollers 3 and 4' project sufficiently beyond the side edges of the longitudinal elements 2 and 2' that they still overlap at the center of the gap 8.

Wholly corresponding thereto, the design of the rollers for the transverse plane III is shown in FIGS. *3a* and *3b*.

FIGS. *2a*, *2b*, and *3a* and *3b*, show that the tubular ware no longer is anywhere affected by part of the longitudinal elements and that the alternating arrangement of the rollers in the transverse planes causes the gaps present between the individual rollers in one plane to be covered by the rollers of the adjoining plane, regardless of the particular operational position of the expander, that is, for any adjustable degree of spreading of the expander, because the ends of the rollers project sufficiently beyond the side edges of the longitudinal elements that even for the spread-out position of the expander, they will cover the center of the gap 8 between neighboring longitudinal elements 2 and 2'. Thus the entire periphery of the tubular ware is guided and hence uniformly loaded. Longitudinal streaks therefore no longer can be generated.

The invention furthermore offers the advantages of the initially mentioned wavy clearances or flutings in the surfaces of the guide elements. In this case also it is feasible, as already suggested, to arrange nozzles, for spraying a liquid treatment, in an annular manner around the expander. The treatment liquid itself can be applied to take effect optimally between the rollers in lieu of the wave troughs of fluting. Lastly, the transverse planes need not all be arranged at mutually equal spacings, rather the transverse planes also can be paired. Nor is it necessary to provide the roller arrangement across the entire length of an expander, rather it may be adequate in many cases to equip only part of the expander with the undriven rollers of the invention.

It will be obvious to those skilled in the art that many modifications may be made within the scope of the present invention without departing from the spirit thereof, and the invention includes all such modifications.

What I claim is:

1. In an externally held cylindrical expander for tubular ware with a central support for radially adjustable, spreading rest means and sector-shaped longitudinal elements borne by said rest means, in particular for the treatment of the tubular ware with liquid treatment means, the longitudinal elements extending between bodies tapering in the longitudinal direction, mounted between the ends of the support, and acting as entry and exit means, the improvement comprising:

(a) rollers with axes of rotation transverse to the ware transport direction T mounted on the outsides of the individual longitudinal elements in transverse planes of the expander, (b) the rollers located in a common transverse plane covering the gaps between rollers located in an adjoining transverse plane, (c) the rollers from adjoining transverse planes mounted on one longitudinal element overlap by their ends at the center of said longitudinal element, (d) the other ends of the rollers project beyond the side edges of said longitudinal element and overlap with the rollers of the adjoining longitudinal element, and (e) the rollers evince a convex profile of such kind that the convex curvature of all rollers located in a common transverse plane on the expander periphery coincides with the smallest settable circumference of the expander in its unspread position.

2. An expander according to claim 1 in which the roller ends projecting beyond the side edges of the longitudinal elements cover the center of the maximum gap between two adjoining longitudinal elements when the expander is in the spread-out position.

3. An expander according to claim 1 or claim 2 in which the transverse planes are paired.

4. An expander according to claim 1 in which the longitudinal elements include feed incline means for the tubular ware at the beginning and end of the roller arrangement.

* * * * *